US011415399B1

(12) United States Patent
Beckett et al.

(10) Patent No.: US 11,415,399 B1
(45) Date of Patent: Aug. 16, 2022

(54) IGNITION APPARATUS FOR PROJECTILE

(71) Applicant: The United States of America as Represented by the Secretary of the Navy, Indian Head, MD (US)

(72) Inventors: Kyle Matthew Beckett, Leonardtown, MD (US); Earle Monroe Sparks, Ridgely, MD (US); Xavier Omar Velez-Ocasio, King George, VA (US); David Reinaldo Gonzalez, King George, VA (US); Greg Young, Blacksburg, VA (US)

(73) Assignee: The United States of America as represented by the Secretary of the Navy, Washington, DC (US)

( * ) Notice: Subject to any disclaimer, the term of this patent is extended or adjusted under 35 U.S.C. 154(b) by 57 days.

(21) Appl. No.: 16/974,274

(22) Filed: Dec. 15, 2020

(51) Int. Cl.
*F42C 15/24* (2006.01)
*F42C 15/20* (2006.01)

(52) U.S. Cl.
CPC ..... *F42C 15/24* (2013.01); *F42C 15/20* (2013.01)

(58) Field of Classification Search
CPC ..... F42C 1/02–06; F42C 14/00; F42C 15/16; F42C 15/20; F42C 15/24; F42C 15/26
USPC ..... 102/216, 247, 251, 252
See application file for complete search history.

(56) References Cited

U.S. PATENT DOCUMENTS 4,417,498 A 11/1983 Dissmyer et al.
4,557,198 A * 12/1985 Hickey ..... F42B 12/58 102/489
6,321,654 B1 * 11/2001 Robinson ..... F42C 15/24 102/251
6,851,348 B1 2/2005 Ang
7,779,740 B1 8/2010 Holmes et al.
8,061,271 B2 11/2011 Murray et al.
8,833,261 B1 9/2014 Thorniley et al.
10,386,144 B1 8/2019 Facteau et al.
2007/0295233 A1 * 12/2007 Karmazyn ..... F42C 15/40 102/251
2008/0011179 A1 * 1/2008 Michel ..... F42C 1/04 102/254
2008/0110365 A1 5/2008 Rasteghar et al.
2010/0031841 A1 * 2/2010 Michel ..... F42C 15/184 102/222
2021/0095942 A1 * 4/2021 Koehler ..... F42C 15/36

FOREIGN PATENT DOCUMENTS

GB 2006401 A * 5/1979 ..... F42C 1/02

* cited by examiner

*Primary Examiner* — Bret Hayes
(74) *Attorney, Agent, or Firm* — Fredric J. Zimmerman

(57) ABSTRACT

Exemplary embodiments of an ignition apparatus are disclosed herein. Each ignition apparatus is configured for use in a projectile, such as an artillery projectile, rocket, missile, drone, and other similar projectiles. In each exemplary embodiment disclosed herein, the ignition apparatus initiates an ignition sequence that is the reverse of the ignition sequences implemented by conventional ignition devices that utilize pre-loaded or pre-compressed spring-operated firing pins. Each exemplary embodiment of the ignition apparatus disclosed herein utilizes the extreme axial acceleration of the projectile to arm and initiate the ignition sequence.

20 Claims, 13 Drawing Sheets

IGNITION APPARATUS FOR PROJECTILE

STATEMENT OF GOVERNMENT INTEREST

The invention described herein may be manufactured and used by or for the Government of the United States of America for governmental purposes without the payment of any royalties thereon or therefor.

CROSS REFERENCE TO OTHER PATENT APPLICATIONS

None.

TECHNICAL FIELD

The present invention relates to an ignition apparatus for use with projectiles such as artillery projectiles, rockets, missiles or drones.

BACKGROUND

Projectiles with on-board means of chemical propulsion, such as artillery projectiles, rockets, missiles or drones, typically utilize ignition devices that initiate a firing sequence that results in the generation of chemical energy. Such ignition devices utilize inertial components to arm and release a firing pin in the ignition sequence. Typically, ignition devices comprise mechanical ignitions that utilize a firing pin to impact a percussion primer so as to transform the mechanical energy into chemical energy. In many conventional mechanical ignition systems, the required energy for ignition is pre-loaded or stored in a spring system. These springs are compressed or expanded to generate the designed potential energy. The springs are released once predefined conditions occur. A disadvantage of this type of conventional ignition system is a phenomenon known as "creep". The "creep" phenomenon occurs when a spring maintains a high stress for an extended duration and incurs a permanent deformation that reduces the available energy. Furthermore, in conventional spring loaded ignition systems, the energy is stored and therefor always present but is restrained by a safety mechanism or out-of-alignment orientation. Failure of the safety mechanism or out-of-alignment orientation would cause premature activation of the ignition system.

What is needed is an improved ignition device that does not utilize pre-loaded springs or similar pre-loaded mechanical devices.

SUMMARY

This summary is provided to introduce a selection of concepts in a simplified form that are further described below in the detailed description. This summary is not intended to identify key features or essential features of the claimed subject matter, nor is it intended to be used in isolation as an aid in determining the scope of the claimed subject matter.

Exemplary embodiments of an ignition apparatus are disclosed herein. Each ignition apparatus is configured for use in a projectile that is designed for airborne movement such as an artillery projectile, rocket, missile, drone, etc. In each embodiment disclosed herein, the ignition apparatus initiates an ignition sequence that is the reverse of the ignition sequences implemented by conventional ignition devices that utilize pre-loaded or pre-compressed spring-operated firing pins. Each embodiment of the ignition apparatus disclosed herein utilizes the extreme axial acceleration of the projectile to arm and initiate the ignition sequence. Generally, the projectile is launched or fired from a launching or firing apparatus, respectively. For example, if the projectile is an artillery projectile, then the firing apparatus is an artillery cannon. In such a case, the projectile accelerates through the barrel of artillery cannon after the artillery cannon is fired. This acceleration of the projectile is used to initiate the ignition sequence.

In each of the embodiments of the ignition apparatus disclosed herein, the ignition apparatus includes a housing that is attached or joined to the interior structure of the projectile and a sleeve that is within and attached or joined to the housing. A firing pin is located within the sleeve and is initially held stationary by a fracturable constraint device. The fracturable constraint device abuts an open end of the sleeve. The fracturable constraint device fractures upon being subjected to a predetermined magnitude of force. In one example, the predetermined magnitude of force occurs when the projectile achieves a predetermined magnitude of acceleration as the projectile is accelerating through the barrel of the artillery cannon. In some embodiments, the fracturable constrain device is configured to fracture when it is subjected to a predetermined magnitude of tensile force. In other embodiments, the fracturable constraint device is configured to fracture when it is subjected to a predetermined magnitude of shear force. When the projectile is fired from an artillery cannon, axial acceleration accelerates the projectile through the barrel of the artillery cannon. The firing pin initially resists this axial acceleration. When the axial acceleration of the projectile attains a predetermined magnitude, the inertial mass of the firing pin exerts a tensile or shear force on the fracturable constraint device causing the fracturable constraint device to fracture. Once the fracturable constraint device fractures, the firing pin is released and ceases to accelerate with the projectile. The firing pin now floats within the sleeve and may exhibit axial movement within the sleeve. The projectile and sleeve are now moving with respect to the firing pin. The velocity of the projectile is now greater than the velocity of the firing pin such that a differential velocity exists. This differential velocity increases as the projectile moves through the barrel. The percussion primer is positioned within the sleeve and located at the lengthwise end of the sleeve that is opposite the end of the sleeve where the fracturable constraint device is located. Since the sleeve is attached to the interior structure of the projectile and the percussion primer is secured within the sleeve, the percussion primer accelerates with the projectile and is moving toward the floating firing pin as the projectile accelerates out of the barrel. The sleeve has a predetermined length that is sufficient to allow the percussion primer to accelerate into the firing pin with an impact that is sufficient to activate the percussion primer. Once activated, the percussion primer produces hot particles and gases that initiate combustion of energetic material stored within an adjacent combustion chamber. One example of such energetic material is Boron Potassium Nitrate ($BKNO_3$). The combustion of the energetic material in the combustion chamber causes combustion of a cylindrical solid propellant casting that extends about the sleeve and which is adjacent to the combustion chamber. Once combustion starts, the cylindrical solid propellant casting continues to combust until fully consumed. The combustion of the cylindrical solid propellant casting produces hot combustion products that flow through a plurality of gas ports and into a ramjet combustor of the projectile. The hot combustion products activate an onboard ramjet. The ignition apparatus may be configured in accordance with a particular geometry of the projectile or with the specific mechanical energy required to activate a percussion primer.

In some exemplary embodiments, the ignition apparatus includes a housing having an interior and a rear central opening in communication with the interior. A sleeve is positioned within the interior of the housing and has a predetermined length, an interior space, a front end having a front opening and a rear end having a rear opening. The front opening and rear opening of the sleeve are in in communication with the interior space and the rear opening of the sleeve is aligned with the rear central opening of the housing. The ignition apparatus further includes a fracturable constraint device that is positioned within the interior of the housing and is adjacent to the rear central opening. The fracturable constraint device has a front side that is in abutting relation with the rear end of the sleeve and a rear side that faces the rear central opening. The fracturable constraint device is configured to fracture when subjected to a predefined magnitude of force caused by axial acceleration of the projectile. The ignition apparatus further includes a cap that is attached to the housing and is positioned within the rear central opening. The cap abuts the rear side of the fracturable constraint device such that the fracturable constraint device is maintained in abutting relation with the rear end of the sleeve. A firing pin is positioned within the interior space of the sleeve and is configured to have high-density so as to provide high inertial mass. The firing pin is secured to the fracturable constraint device. A percussion primer positioned within the interior space of the sleeve and is spaced apart from the firing pin. The fracturable constraint device fractures upon being subjected to the predefined magnitude of force thereby setting free the firing pin such that the firing pin does not accelerate with the projectile and is free to move within the interior space of the sleeve. Whereby, sustained axial acceleration of the projectile, the predetermined length of the sleeve and the high density portion of the firing pin cooperate to enable the firing pin to impact with the percussion primer with a force that is sufficient to activate the percussion primer.

DETAILED DESCRIPTION

As used herein, the terms "comprises", "comprising", "includes", "including", "has", "having" or any other variation thereof, are intended to cover a non-exclusive inclusion. For example, a process, method, article or apparatus that comprises a list of elements is not necessarily limited to only those elements, but may include other elements not expressly listed or inherent to such process, method, article or apparatus.

It is to be understood that throughout this description, terms such as "vertical", "horizontal", "top", "bottom", "upper", "lower", "middle", "above", "below" and the like are used for convenience in identifying relative locations of various components and surfaces relative to one another in reference to the drawings and are not intended to be limiting in any way.

Reference in the specification to "an exemplary embodiment", "one embodiment" or "an embodiment" means that a particular feature, structure or characteristic described in connection with the embodiment is included in at least one embodiment of the invention. The appearances of the phrases "an exemplary embodiment", "one embodiment" or "embodiment" in various places in the specification are not necessarily all referring to the same embodiment.

Approximating language, as used herein throughout the specification and claims, may be applied to modify any quantitative representation that could permissibly vary without resulting in a change in the basic function to which it is related. Accordingly, a value modified by a term such as "about" or "approximately" is not limited to the precise value specified.

Figure 1:
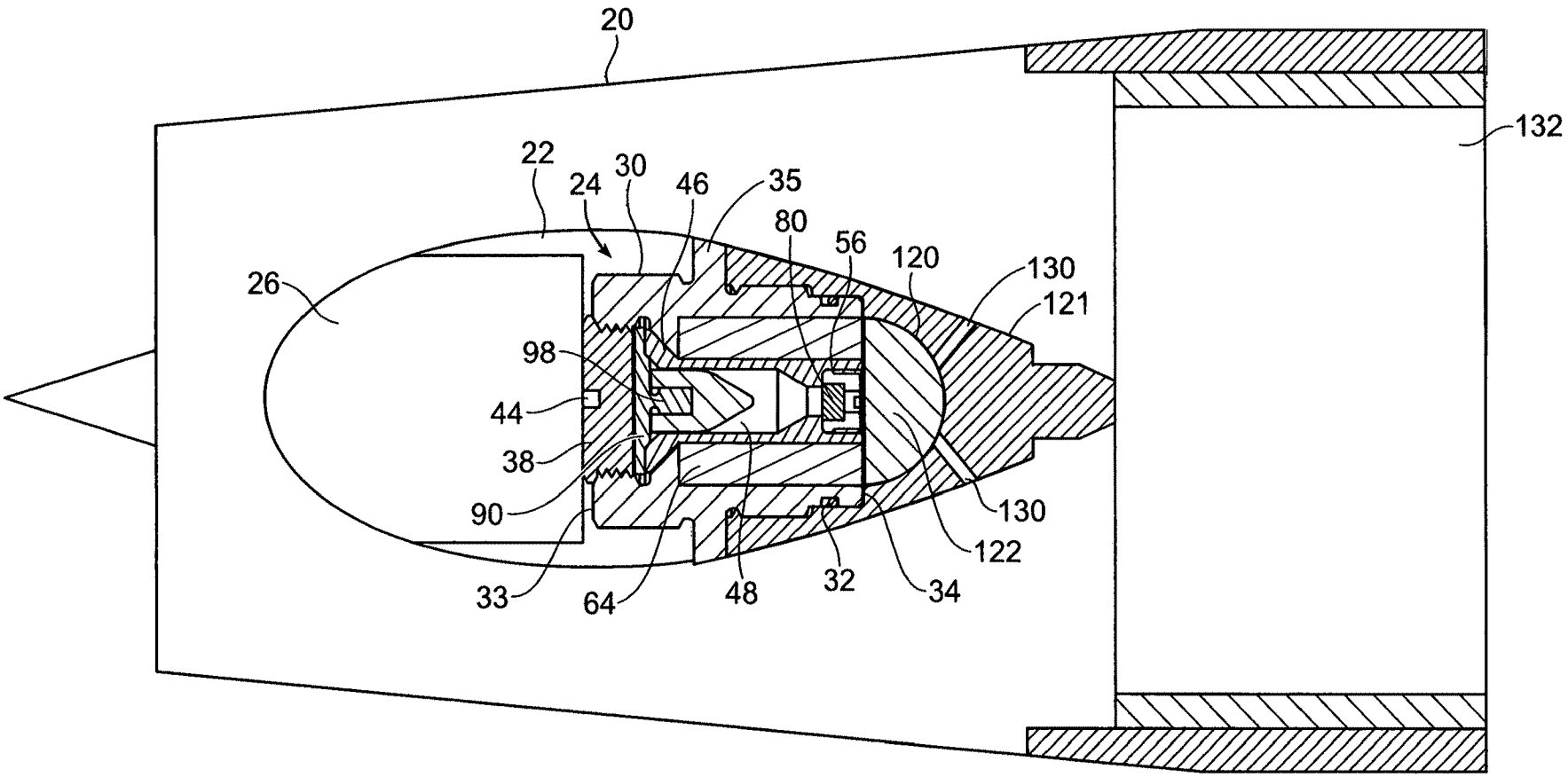
FIG. 1 is a side elevational view, partially in cross-section, of the front portion of a projectile having therein an exemplary embodiment of the ignition apparatus, the view showing a portion of the projectile cut away in order to facilitate viewing of the ignition apparatus which is located within the interior of the projectile.
Figure 2:
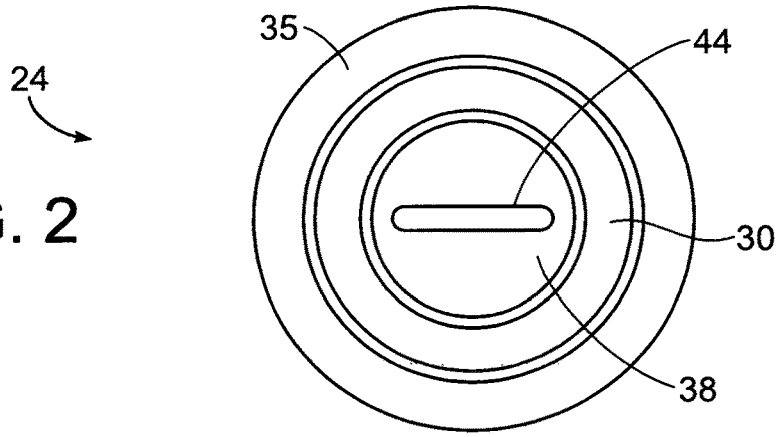
FIG. 2 is a rear end view of the ignition apparatus, the view showing a housing and cap member attached to the housing.
Figure 3:
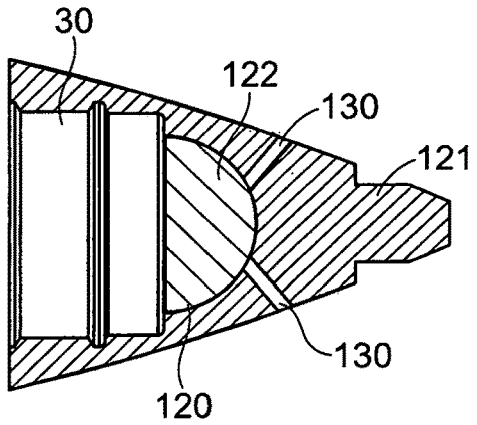
FIG. 3 is a side view, in elevational and partially in cross-section, of a housing, combustion chamber and nozzle cap shown in FIG. 1.

Referring to FIG. 1, there is shown a side elevational view, partially in cross-section, of a front portion of projectile 20 having interior region 22 and an interior structure and wall (not shown). For purposes of describing the embodiments herein, the ensuing description is in terms of projectile 20 being configured as an artillery projectile fired from an artillery cannon having a barrel. The view in FIG. 1 shows a portion of projectile 20 cut away in order to facilitate viewing of interior region 22 of projectile 20. Positioned within interior region 22 is ignition apparatus 24 in accordance with an exemplary embodiment of the present invention. Ignition apparatus 24 is positioned adjacent to telemetry module 26, which includes electronic components that are pertinent to the operation and flight of projectile 20. Telemetry module 26 is attached or mounted to the interior structure or wall of projectile 20. Telemetry module 26 is well known in the art and is therefore not described herein in detail.

Figure 4A:
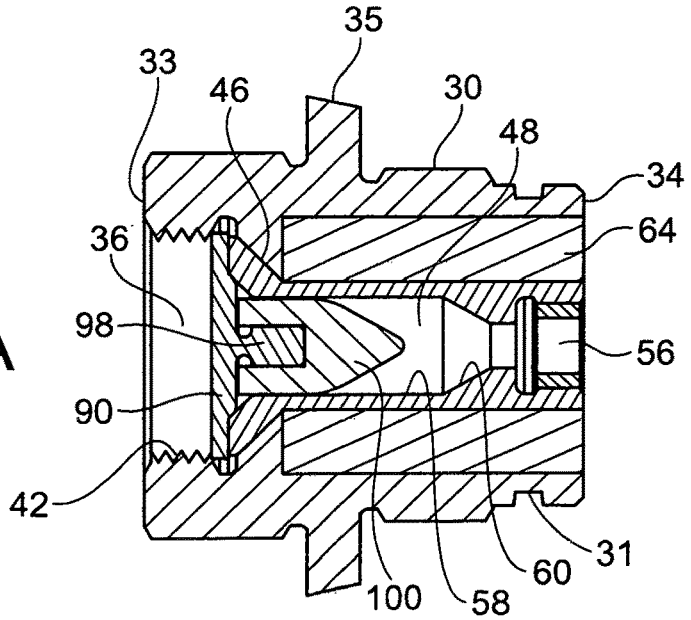
FIG. 4A is a cross-sectional view of the ignition apparatus without the cap member, combustion chamber and nozzle cap.
Figure 4C:
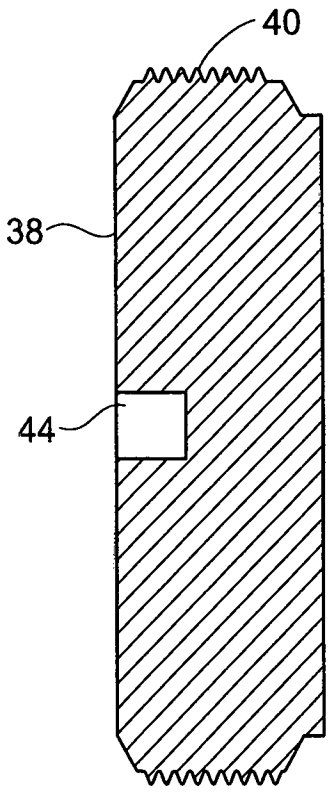
FIG. 4C is a cross-sectional view taken along line 4C-4C of FIG. 4B.
Figure 4B:
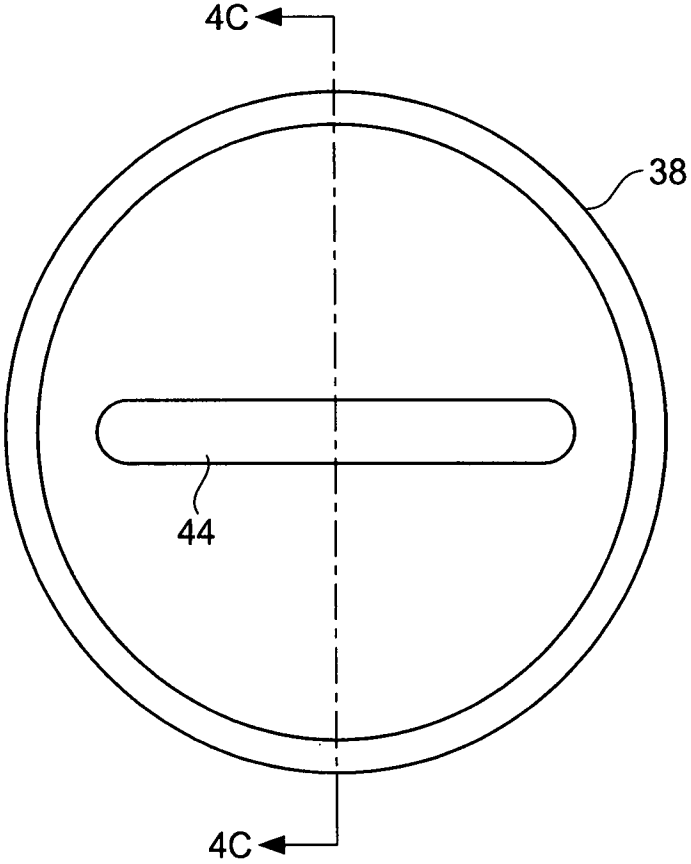
FIG. 4B is an front view of the cap member.
Figure 5:
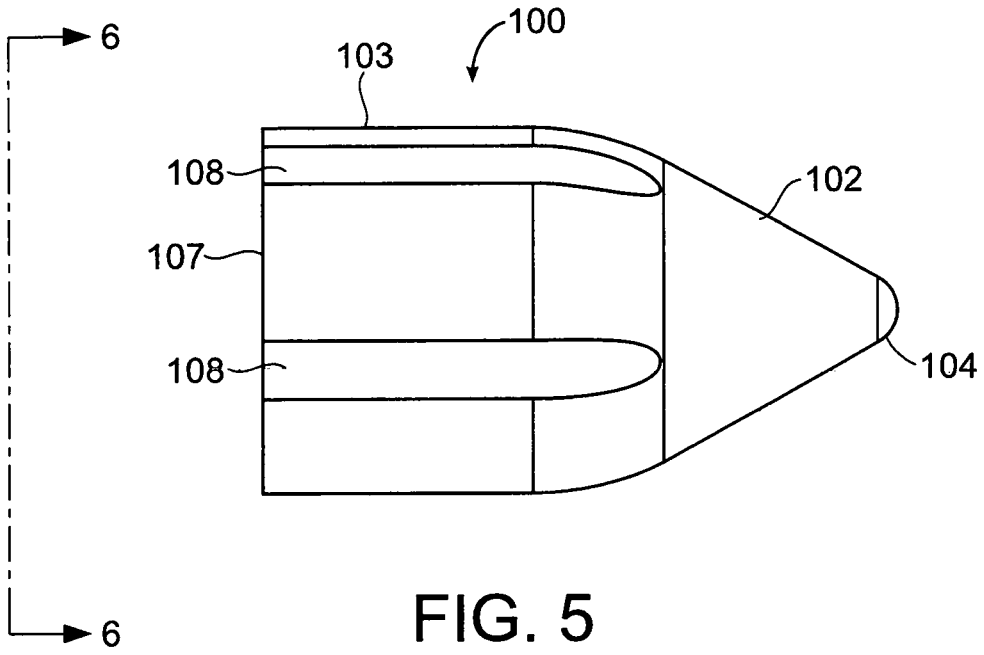
FIG. 5 is a side elevational view of a firing pin shown in FIG. 1.

Referring to FIGS. 1, 2, 3, 4A, 4B and 4C, ignition apparatus 24 includes housing 30 that is attached, joined or secured to the interior structure (not shown) of projectile 20. Housing 30 includes a circumferentially extending grove 31 for receiving seal 32. Seal 32 provides a seal between housing 30 and the interior structure (not shown) of projectile 20. In an exemplary embodiment, housing 30 has a substantially cylindrical shape. Housing 30 has rear end 33, front end 34 and circumferentially extending flange portion 35. Rear end 33 extends about central opening 36 (see FIG. 4A). Central opening 36 is sized to receive cap member 38. Cap member 38 is also shown in FIGS. 4B and 4C. In an exemplary embodiment, cap member 38 includes circumferentially extending threads 40 that are configured to engage corresponding threads 42 that are on housing 30 and which extend about central opening 36. Cap member 38 includes slot 44 therein that is configured to receive a tool (not shown) that is used to screw cap member 38 into central opening 36. In other embodiments, cap member 38 is frictionally fitted within central opening 36.

Figure 10:
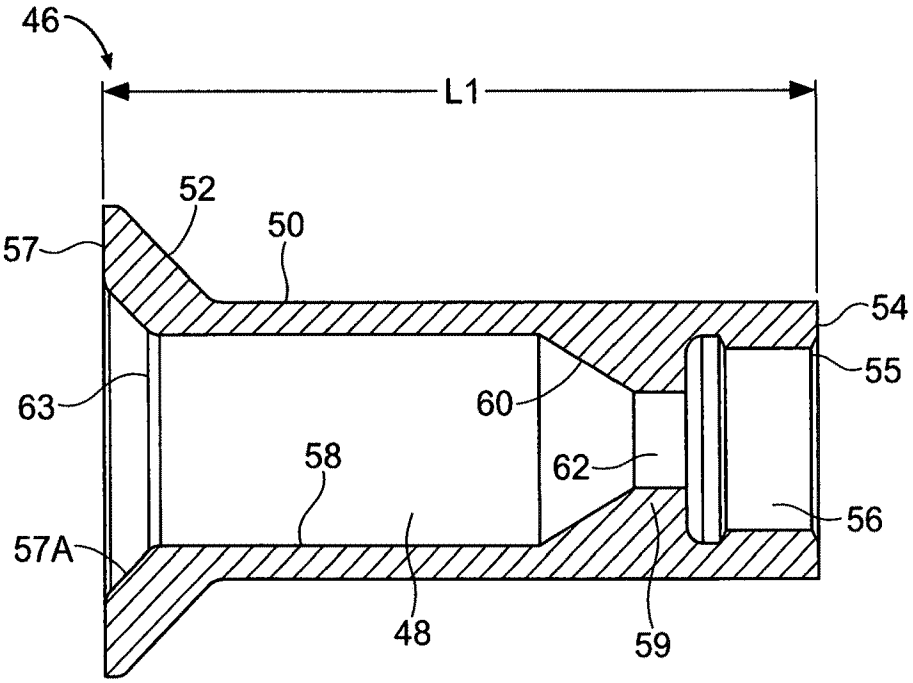
FIG. 10 is a cross-sectional view taken along line 10-10 of FIG. 9.
Figure 9:
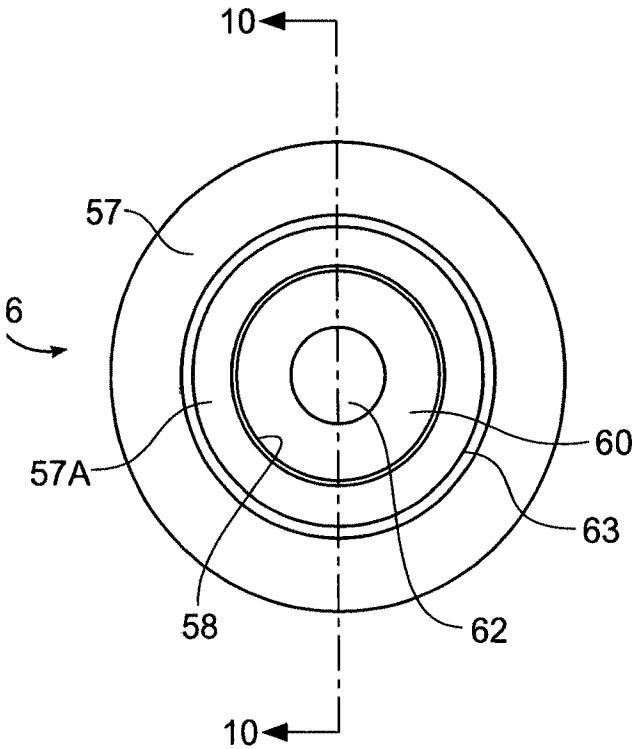
FIG. 9 is a rear end view of a firing pin sleeve shown in FIG. 1.

Referring to FIGS. 1, 4A, 9 and 10, ignition apparatus 24 further includes sleeve 46 that is located within housing 30. In an exemplary embodiment, sleeve 46 is fabricated from metal. Suitable metals include, but are not limited to, Aluminum, steel, iron, copper and brass. In other exemplary embodiments, sleeve 46 is fabricated non-metal materials. Examples of such non-metal materials include, but are not limited to, plastic, resin, PVC, and composites. Sleeve 46 is adjacent to combustion chamber 120. Combustion chamber 120 is located within nozzle cap 121. Combustion chamber 120 is discussed in detail in the ensuing description. In an exemplary embodiment, sleeve 46 is press-fitted into a bore or internal space or region of housing 30. Sleeve 46 has a predetermined length L1 (see FIG. 10). Sleeve 46 has an interior space that includes first interior space 48 that is sized for holding firing pin 100, which is discussed in detail in the ensuing description. Sleeve 46 includes substantially cylindrical section 50, angulated portion 52 and front end 54. Front end 54 has opening 55. The interior space of sleeve 46 further comprises second interior space 56 that is sized for holding percussion primer 80 which is discussed in the ensuing description. Sleeve 46 further includes rear end 57 which has beveled portion 57A. Sleeve 46 includes interior wall 58. Interior wall 58 includes internal structure 59 that is located between first interior space 48 and second interior space 56. Internal structure 59 is configured to provide angulated portion 60. Angulated portion 60 defines a substantially conical shape that corresponds to the conical shape of forward portion 102 of firing pin 100. These aspects of ignition apparatus 24 are discussed in detail in the ensuing description. As shown in FIG. 10, internal structure 59 includes central opening 62 that allows first interior space 48 to be in communication with second interior space 56. Internal structure 59 is configured so that the diameter of central opening 62 is substantially smaller than the diameter of opening 63 in rear end 57 of sleeve 46. Central opening 62 is sized to allow nose portion 104 of firing pin 100 to protrude through central opening 62 and extend into second interior space 56 so as to physically contact percussion primer 80. FIG. 10 does not show percussion primer 80 in order to facilitate viewing of second interior space 56. When percussion primer 80 is positioned within second interior space 56, percussion primer 80 abuts internal structure 59. Opening 63 in rear end 57 is in communication with first interior space 48 and is sized for receiving firing pin 100. As shown in FIGS. 1 and 4A, ignition apparatus 24 further includes cylindrical solid propellant casting 64 that is located within housing 30 and positioned between the inner wall of housing 30 and sleeve 46. Since solid propellant casting 64 is cylindrically shaped, it extends about sleeve 46. The purpose of solid propellant casting 64 is discussed in detail in the ensuing description.

Figure 6:
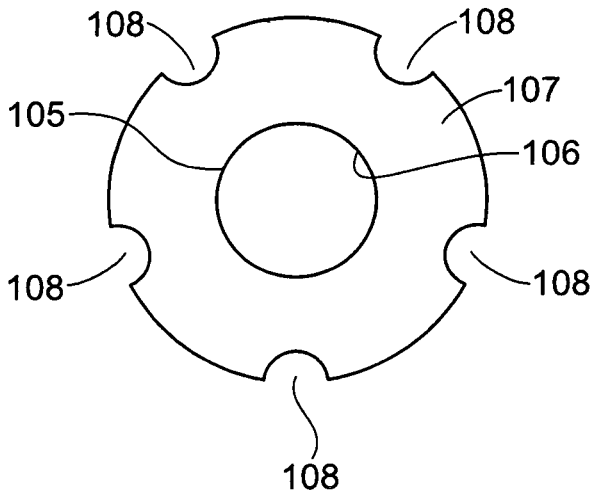
FIG. 6 is a rear end view of the firing pin taken along line 6-6 of FIG. 5.
Figure 7:
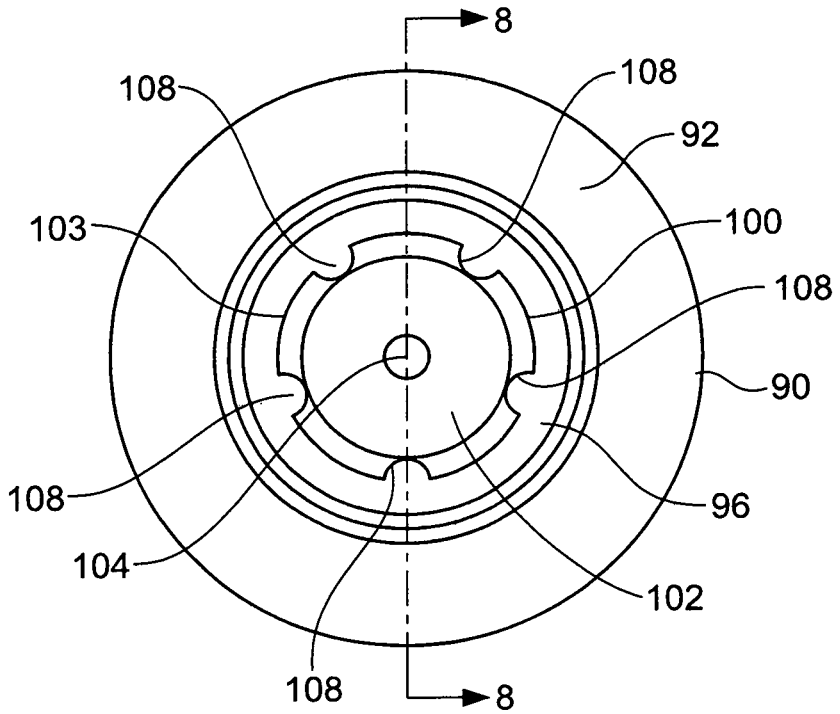
FIG. 7 is a view of the firing pin secured to a fracturable constraint device as seen from the front of the firing pin.
Figure 8:
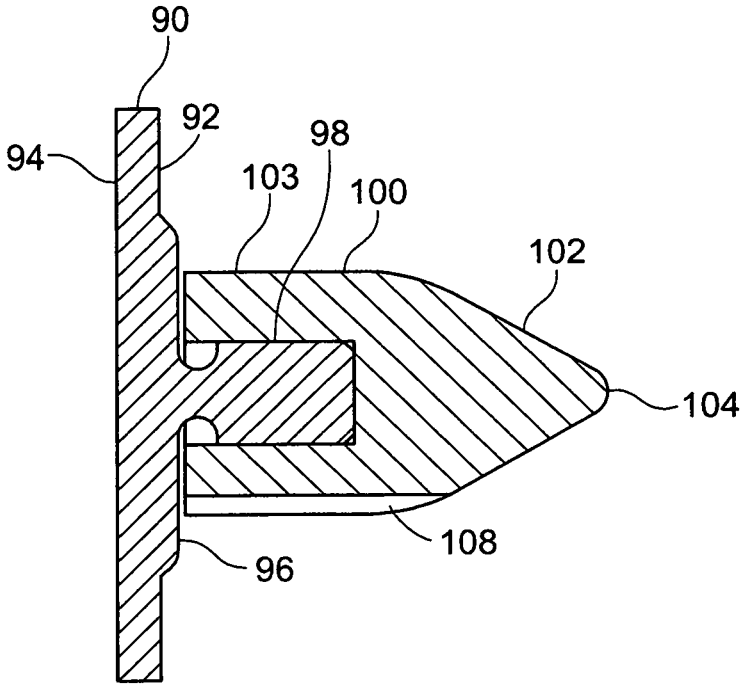
FIG. 8 is a cross-sectional view taken along line 8-8 of FIG. 7.
Figure 12:
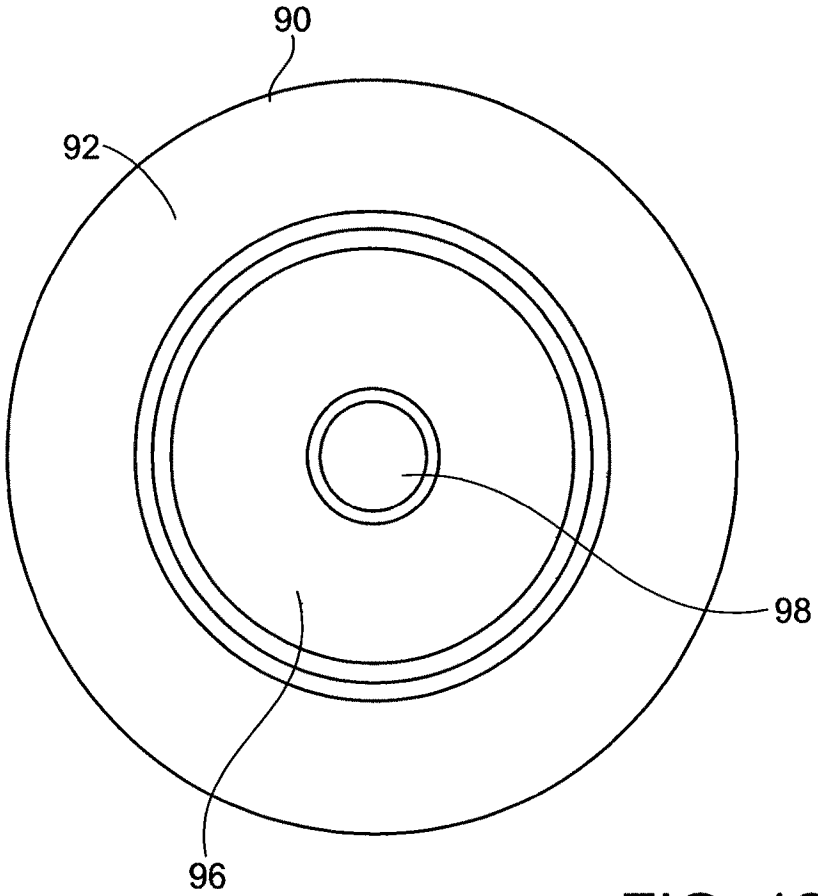
FIG. 12 is a view taken along line 12-12 of FIG. 11.
Figure 11:
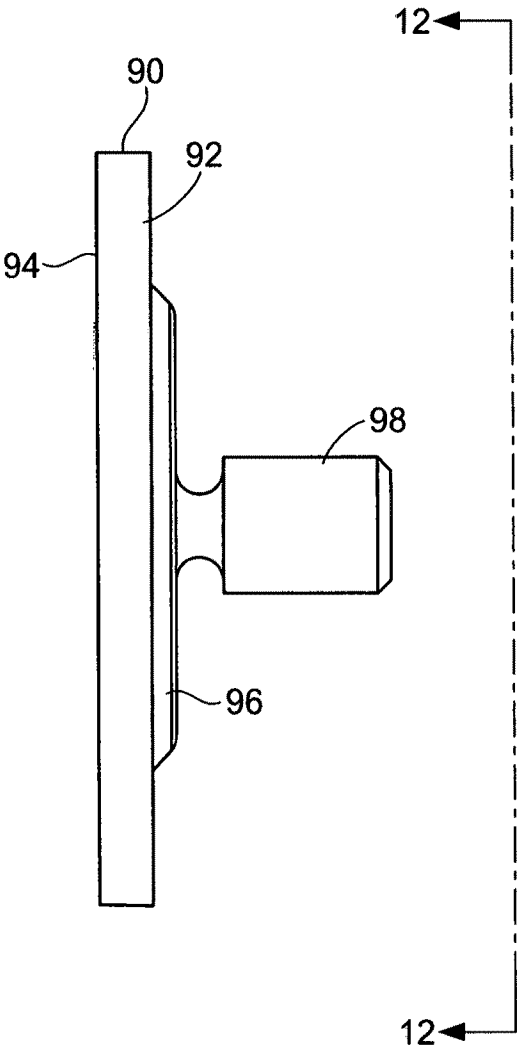
FIG. 11 is a side-elevational view of the fracturable constraint device shown in FIGS. 1, 7 and 8.

Referring to FIGS. 1, 11 and 12, ignition apparatus 24 further includes fracturable constraint device 90. Fracturable constraint device 90 fractures upon being subjected to a predetermined magnitude of force. The predetermined magnitude of force occurs when projectile 20 achieves a predetermined magnitude of acceleration. Fracturable constraint device 90 is substantially circular in shape and includes front side 92 and rear side 94. In an exemplary embodiment, fracturable constraint device 90 is fabricated from a thermoplastic polymer. An example of such a thermoplastic polymer is PEEK (Polyether Ether Ketone). In other embodiments, fracturable constraint device 90 is fabricated from an Acrylic Resin. As shown in FIG. 1, cap member 38 is screwed into central opening 36 in housing 30 until cap member 38 is in abutting relation with rear side 94 of fracturable constraint device 90. In this configuration, cap member 38 keeps front side 92 of fracturable constraint device 90 in physical contact with rear end 57 of sleeve 46. Fracturable constraint device 90 further includes base portion 96 and protruding portion 98. Protruding portion 98 outwardly extends from base portion 96. Protruding portion 98 is integral with base portion 96. In an exemplary embodiment, protruding portion 98 has a knob-like shape. Protruding portion 98 is sized to fit within bore 105 in firing pin 100. Bore 105 has inner wall 106 (see FIGS. 1 and 6). An epoxy is used to attach protruding portion 98 to inner wall 106. In other embodiments, protruding portion 98 is sized to frictionally fit within bore 105 in firing pin 100. Fracturable constraint device 90 is configured to have a relatively low strain rate so that it will fracture during axial acceleration of projectile 20. During such axial acceleration, projectile 20 is moving through the barrel from right to left when viewing FIG. 1. Such axial acceleration produces tensile force on fracturable constraint device 90. When the tensile force reaches a predetermined magnitude, protruding portion 98 breaks off the base portion 96 thereby setting free firing pin 100. Once free, firing pin 100 is free to move with respect to sleeve 46. Thus, firing pin 100 may move from left to right when viewing FIG. 1.

Referring to FIGS. 1, 4A, 5 and 6, firing pin 100 comprises forward section 102 and body section 103. In an exemplary embodiment, forward section 102 is joined or attached to body section 103. Forward section 102 has a substantially conical shape and includes nose portion 104. The conical shape of forward portion 102 corresponds to the conical shape provided by angulated portion 60 as discussed in the foregoing description. In an exemplary embodiment, body section 103 has a substantially cylindrical shape. Body section 103 includes bore 105 which was discussed in the foregoing description. Bore 105 has inner wall 106 for receiving protruding portion 98 of fracturable constraint device 90 as discussed in the foregoing description. Body section 103 includes rear end 107 which abuts base portion 96 of fracturable constraint device 98. Body section 103 includes at least one longitudinally extending channel 108 formed therein. In an exemplary embodiment, there is a plurality of channels 108 that are equidistantly spaced. Channels 108 prevent compressed air from interfering with the movement of firing pin 100 once fracturable constraint device 90 fractures and firing pin 100 is set free. First interior space 48 of sleeve 46 is a closed volume that contains trapped air. Without channels 108, this trapped air would compress when firing pin 100 attempts to move toward percussion primer 80 or when percussion primer 80 approaches firing pin 100 due to the movement projectile 20. Such air compression would cause deceleration of firing pin 100. However, channels 108 allow the air within the closed volume to pass around firing pin 100 thereby eliminating any compression of air. In an exemplary embodiment, body section 103 is fabricated from a high-density material in order provide high inertial mass so as to maximize the impact of firing pin 100 on percussion primer 80. In an exemplary embodiment, the high-density material is Tungsten. However, other suitable high-density materials also may be used.

After projectile 20 is launched or fired, projectile 20 accelerates through the barrel. Fracturable constraint device 90 remains intact until projectile 20 achieves a predetermined rate of axial acceleration. The predetermined rate of acceleration translates into a predetermined magnitude of force being applied to fracturable constraint device 90. In response to the applied predetermined magnitude of force, protruding portion 98 breaks off of fracturable constraint device 90 thereby releasing firing pin 100. When firing pin 100 is released, it ceases to accelerate with projectile 20. Firing pin 100 now floats within sleeve 46 and may exhibit axial movement toward percussion primer 80. Projectile 20 is now moving with respect to firing pin 100. The velocity of projectile 20 is now greater than the velocity of firing pin 100 such that a differential velocity exists. This differential velocity increases as projectile 20 moves through the barrel. As shown in FIG. 1, percussion primer 80 is located at the lengthwise end of sleeve 46 that is opposite the fracturable constraint device 90. Percussion primer 80 is positioned within second interior space 56 of sleeve 46. Therefore, sleeve 46 and percussion primer 80 accelerate with projectile 20 and move toward the floating firing pin 100 as projectile 20 is accelerating out of the barrel. The predetermined length L1 of sleeve 46 allows percussion primer 80 to accelerate toward firing pin 100 such that nose portion 104 of firing pin 100 passes through central opening 62 (see FIG. 10) and impacts with percussion primer 80 with a force that is sufficient to activate percussion primer 80. Once activated, percussion primer 80 produces hot particles and gases that initiate combustion of energetic material 122 that is stored within the adjacent combustion chamber 120. One example of such energetic material is Boron Potassium Nitrate ($BKNO_3$). Cylindrical solid propellant casting 64 extends about sleeve 46 and is exposed to the interior of combustion chamber 120. The combustion of the energetic material 122 in combustion chamber 120 causes combustion of cylindrical solid propellant casting 64. Once combustion starts, cylindrical solid propellant casting 64 continues to combust until fully consumed. The combustion of cylindrical solid propellant casting 64 produces hot combustion products that flow through a plurality of gas ports 130 in nozzle cap 121 and into ramjet combustor 132 of projectile 20. These hot combustion products activate the ramjet (not shown).

Figure 13:
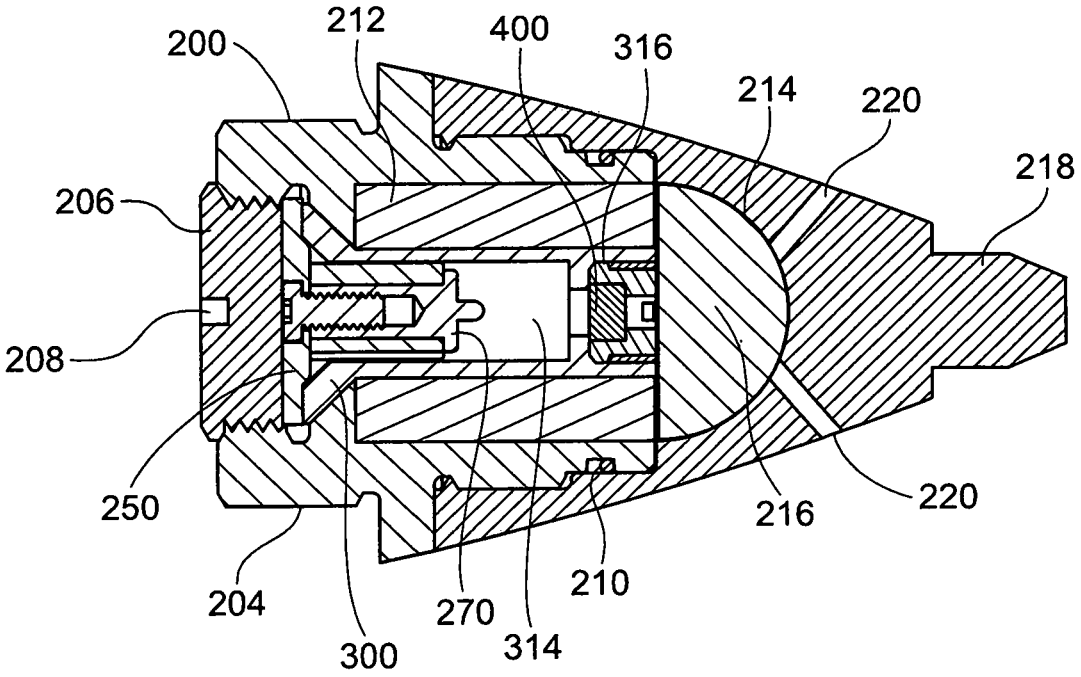
FIG. 13 is a cross-sectional view of an ignition apparatus in accordance with another exemplary embodiment.

Referring to FIG. 13, there is shown ignition apparatus 200 in accordance with another exemplary embodiment. Ignition apparatus 200 is positioned within a projectile (not shown) that is substantially the same in configuration as projectile 20 which was discussed in the foregoing description. Ignition apparatus 200 comprises housing 204 which has the same structure and function as the structure and function, respectively, as housing 30 which was discussed in the foregoing description. Ignition apparatus 200 further includes cap member 206, which has the same structure and function as the structure and function, respectively, as cap member 38 which was discussed in the foregoing description. Cap member 206 includes slot 208 which serves the same purpose as slot 44 of cap member 38. Housing 200 includes a central opening in rear end portion 208 which has the same shape and configuration as central opening 36 of housing 30 which was discussed in the foregoing description. Cap member 206 is screwed into the central opening in the rear end portion 208 in the same manner as cap member 38 is screwed into central opening 36 of housing 30. Ignition apparatus 200 includes seal 210, which has the same configuration and function as seal 32 which is shown in FIG. 1. Cylindrical solid propellant casing 212 has the same structure and function as cylindrical solid propellant casing 64 which was discussed in the foregoing description. Combustion chamber 214 contains energetic material 216. Combustion chamber 214 and energetic material 216 perform the same function as combustion chamber 210 and energetic material 122, respectively, which were discussed in the foregoing description. Combustion chamber 214 is within nozzle cap 218. Nozzle cap 218 performs the same function as nozzle cap 121 which was discussed in the foregoing description. Nozzle cap 218 includes exhaust ports 220 which perform the same function as exhaust ports 130 discussed in the ensuing description.

Figure 15:
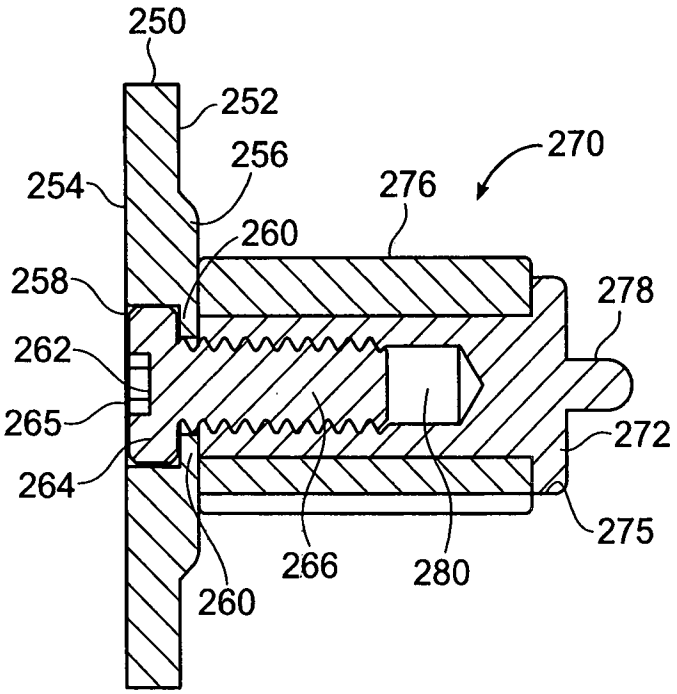
FIG. 15 is a cross-sectional view taken along line 15-15 of FIG. 14.
Figure 14:
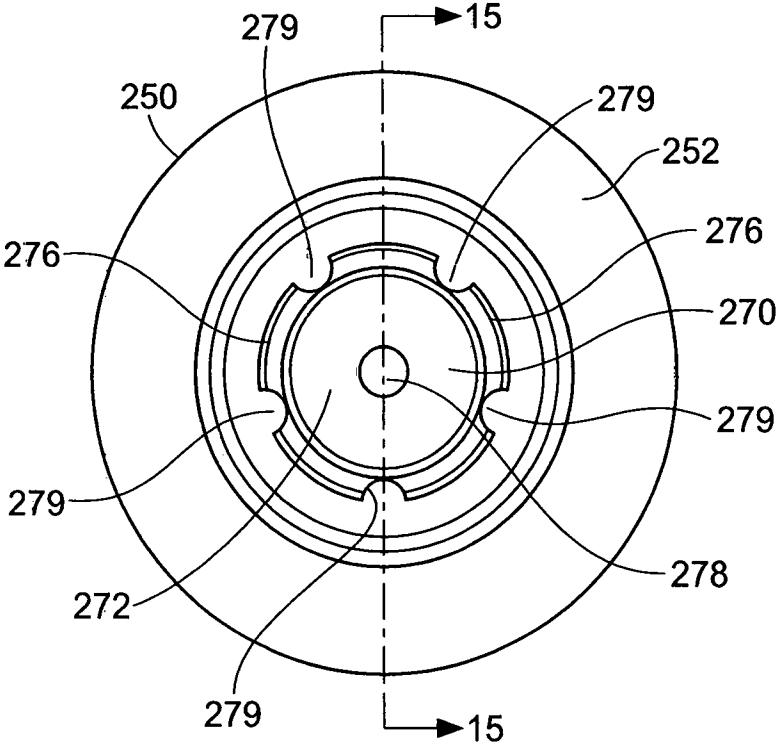
FIG. 14 is a front elevational view showing a firing pin, a high-density ring attached to the fire pin and a fracturable constraint device, all of which being shown in FIG. 13, the firing pin being attached to the fracturable constraint device.
Figure 16:
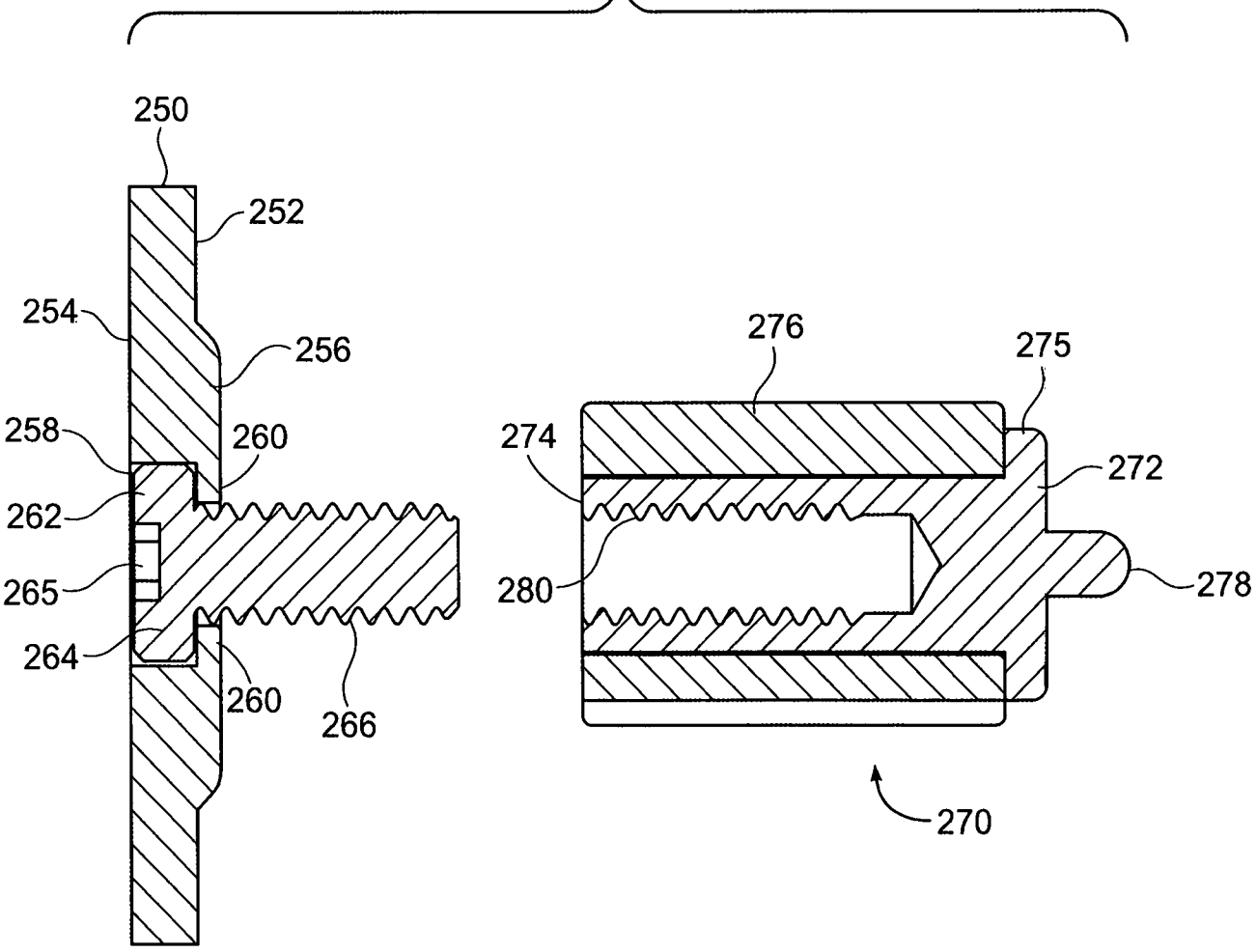
FIG. 16 is an exploded view showing the firing pin, high-density ring and fracturable constraint device of FIG. 14.
Figure 17:
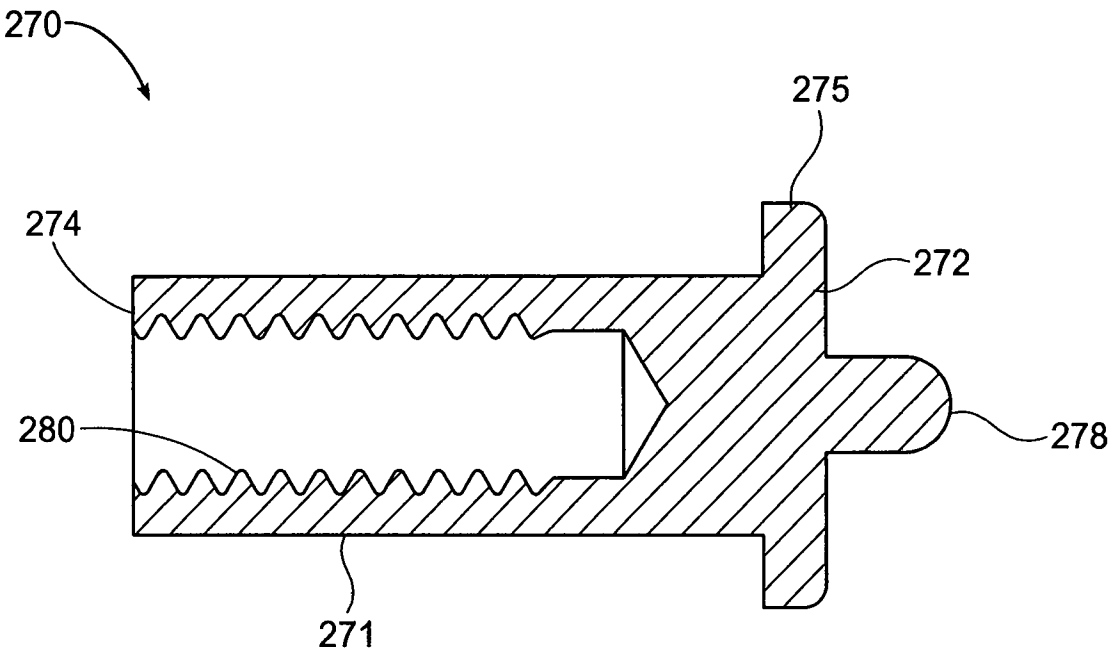
FIG. 17 is a cross-sectional view of the firing pin shown in FIGS. 14, 15 and 16, the view showing the firing pin without the high-density ring in order to facilitate viewing of the firing pin.
Figure 19:
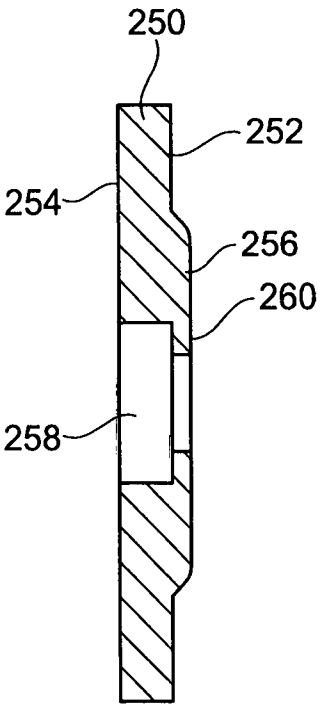
FIG. 19 is a cross-sectional view taken along line 19-19 of FIG. 18.
Figure 18:
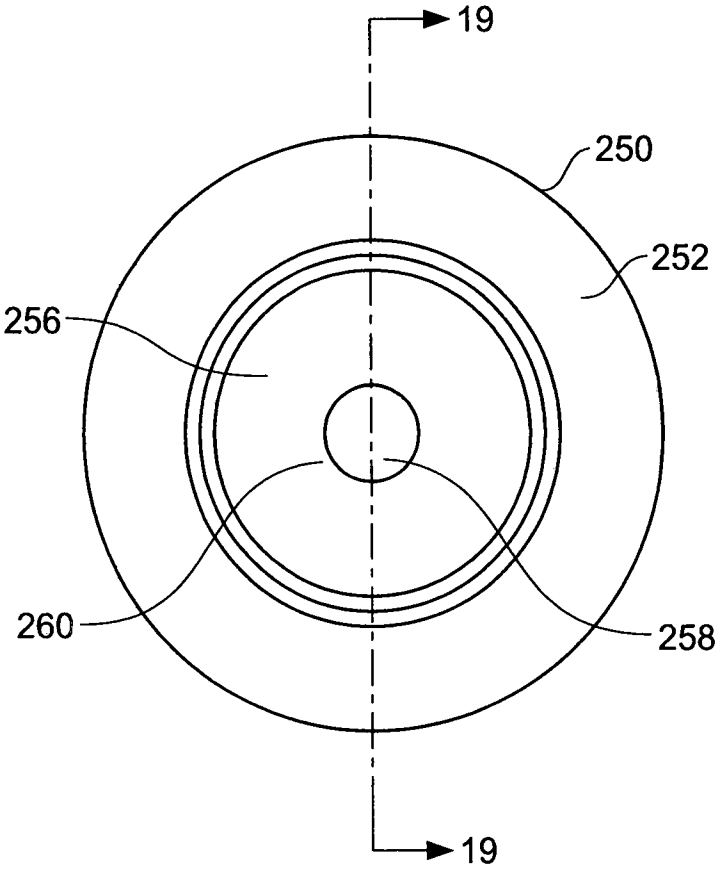
FIG. 18 is a front view of a shear disc shown in FIGS. 13-16.

Referring to FIGS. 13-16, ignition apparatus 200 further includes fracturable constraint device 250. Similar to fracturable constraint device 90 that was discussed in the foregoing description, fracturable constraint device 250 fractures upon being subjected to a predetermined magnitude of force. The predetermined magnitude of force occurs when the projectile achieves a predetermined magnitude of acceleration. In this particular embodiment, fracturable constraint device 250 is configured as a "shear disc." Accordingly, fracturable constraint device 250 is substantially circular in shape and includes front side 252 and rear side 254. In an exemplary embodiment, fracturable constraint device 250 is fabricated from thermoplastic polymer. An example of such a thermoplastic polymer is PEEK (Polyether Ether Ketone). In another exemplary embodiment, fracturable constraint device 250 is fabricated from Acrylic Resin. As shown in FIG. 13, cap member 206 is screwed into the central opening in the rear end portion of housing 204 until cap member 206 abuts rear side 254 of fracturable constrain device 250. Fracturable constraint device 250 further includes central base portion 256. As shown in FIGS. 18 and 19, central base portion 256 has central opening 258 and overhanging portion 260 that extends about and hangs over central opening 258. As shown in FIG. 16, bolt 262 is secured to fracturable constraint device 250. Specifically, bolt 262 includes head 264 that is lodged within central opening 258 and abuts portion 260. Head 264 has slot 265 that is sized to receive a tool such as a screw driver or other tool that can rotate bolt 262. Bolt 262 includes longitudinally extending threaded shank or stem 266 that is joined to or integral with head portion 264. In an exemplary embodiment, shank 266 is integral with head portion 264. As shown in FIG. 16, shank 266 has threads 268 thereon. The purpose of threads 268 is explained in detail in the ensuing description. In an exemplary embodiment, bolt 262 is fabricated from metal. Suitable metals include steel or stainless steel, iron, copper, brass, etc.

Referring to FIGS. 13-17, ignition apparatus 200 further comprises firing pin 270. Firing pin 270 is located within sleeve 300 which is discussed in detail in the ensuing description. Firing pin 270 has a generally cylindrical shaped section 271 and includes front end 272 and rear end 274. In an exemplary embodiment, generally cylindrical shaped section 271, front end 272 and rear end 274 are fabricated from metal. Suitable metals include, but are not limited to, Aluminum, steel, iron, copper and brass. Rear end 274 abuts front side 252 of fracturable constraint device 250. Firing pin 270 further includes circumferentially extending flanged portion 275. Firing pin 270 includes circumferentially extending high-density ring 276 that is attached, joined or mounted to cylindrical shaped section 271 and abuts flanged portion 275. High-density ring 276 provides inertial mass that ensures firing pin 270 will impact percussion primer 400 with a force sufficient to ignite percussion primer 400. Thus, high-density ring 276 maximizes the impact of firing pin 270 on percussion primer 400. In an exemplary embodiment, high-density ring 276 is fabricated from Tungsten. However, other suitable high-density materials also may be used to fabricate high-density ring 276. Firing pin 270 has protruding portion 278 that extends outwardly from front end 272. As will be explained in the ensuing description, protruding portion 278 is configured to strike percussion primer 400 (see FIG. 13). Firing pin 270 includes a plurality of longitudinally extending channels 279 (see FIG. 14) that provide the same function as channels 108 which were discussed in the foregoing description. Firing pin 270 includes threaded bore 280. As shown in FIG. 15, threaded shank 266 is screwed into threaded bore 280. Fracturable constraint device 250 is configured to have a relatively low strain rate so that it will fracture during axial acceleration of the projectile. During such axial acceleration, the projectile is moving through the barrel and the axial acceleration produces shearing forces on fracturable constraint device 250 and bolt 262. When the shearing force reaches a predetermined magnitude, head portion 264 of bolt 262 rips through the material of fracturable constraint device 250 and breaks free of fracturable constraint device 250. As a result, firing pin 270 is set free. Firing pin 270 is now free to move with respect to sleeve 300. Thus, firing pin 270 may move from left to right, when viewing FIG. 13.

Figure 20:
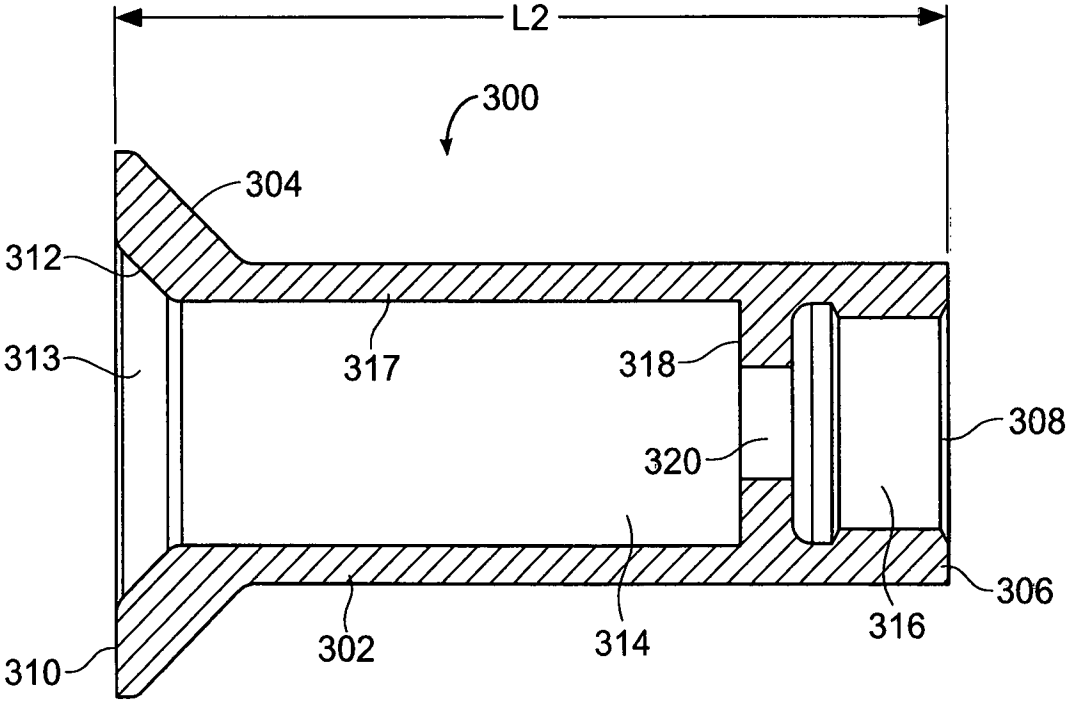
FIG. 20 is a cross-sectional view of the sleeve shown in FIG. 13.

Referring to FIGS. 13 and 20, ignition apparatus 200 further includes sleeve 300 that is located within housing 204. In an exemplary embodiment, sleeve 300 is fabricated from metal. Suitable metals include, but are not limited to, Aluminum, steel, iron, copper and brass. In other embodiments, sleeve 300 is fabricated non-metal materials. Examples of such non-metal materials include, but are not limited to, plastic, resin, PVC, and composites. Sleeve 300 is adjacent to combustion chamber 214. In an exemplary embodiment, sleeve 300 is press-fitted into a bore or interior region of housing 204. Sleeve 300 has a predetermined length L2 (see FIG. 20) and includes substantially cylindrical section 302, angulated portion 304 and front end 306. Front end 306 has opening 308. Angulated portion 304 defines rear end 310. Rear end 310 has beveled portion 312 and central opening 313. As shown in FIG. 13, rear end 310 abuts front side 252 of fracturable constraint device 250. Sleeve 300 has an interior space that comprises first interior space 314 which is in communication with central opening 313 and sized for holding firing pin 270. Firing pin 270 is not shown in FIG. 20 so as to facilitate viewing of the interior region of sleeve 300. The interior space of sleeve 300 further comprises second interior space 316 which is sized for holding percussion primer 400 (see FIG. 13). Percussion primer 400 has the same function and configuration as percussion primer 80 which was discussed in the foregoing description. Percussion primer 400 is not shown in FIG. 20 so as to facilitate viewing of second interior space 316 of sleeve 300. Sleeve 300 includes interior surface 317 and internal structure 318 that is between first interior space 314 and second interior space 316. In an exemplary embodiment, internal structure 318 is integral with sleeve 300 and is not a separate component. In other embodiments, internal structure 318 is attached or joined to the interior surface 317 by any suitable technique, e.g. welding, brazing, etc. As shown in FIG. 20, internal structure 318 includes central opening 320 that allows first interior space 314 to be in communication with second interior space 316. Central opening 320 is sized to allow protruding portion 278 of firing pin 270 to protrude through central opening 320 and extend into second interior space 316 in order to strike percussion primer 400. When percussion primer 400 is positioned within second interior space 316, percussion primer 400 abuts internal structure 318. As shown in FIG. 13, cylindrical solid propellant casting 212 is extends about sleeve 300.

After the projectile is launched or fired, the projectile accelerates through the barrel. Fracturable constraint device 250 remains intact until the projectile achieves a predetermined rate of axial acceleration. The predetermined rate of acceleration produces a predetermined magnitude of shearing force that is applied to or exerted upon fracturable constraint device 250 and bolt 262. In response to this shearing force, head 264 of bolt 262 breaks off of fracturable constraint device 250 thereby releasing firing pin 270. When firing pin 270 is released, it ceases to accelerate with the projectile. Firing pin 270 now floats within sleeve 300 and may exhibit movement toward percussion primer 400. The projectile is now moving with respect to firing pin 270. The velocity of the projectile is now greater than the velocity of firing pin 270 such that a differential velocity exists. This differential velocity increases as the projectile moves through the barrel. As shown in FIG. 13, percussion primer 400 is located at the lengthwise end of sleeve 300 that is opposite fracturable constraint device 250. Percussion primer 400 is positioned within second interior space 316 of sleeve 300. Therefore, sleeve 300 and percussion primer 400 accelerate with the projectile and move toward floating firing pin 270 as the projectile is accelerating out of the barrel. The predetermined length L2 of sleeve 300 allows percussion primer 400 to accelerate toward firing pin 270 so that protruding member 278 of firing pin 270 passes through central opening 320 and strikes percussion primer 400 with sufficient impact to activate percussion primer 400. Once activated, percussion primer 400 produces hot particles and gases that initiate combustion of energetic material 216 that is stored within the adjacent combustion chamber 214. One example of such energetic material is Boron Potassium Nitrate ($BKNO_3$). Cylindrical solid propellant casting 212 extends about sleeve 300 and is exposed to the interior of combustion chamber 214. The combustion of energetic material 216 in combustion chamber 214 causes combustion of cylindrical solid propellant casting 212. Once combustion starts, cylindrical solid propellant casting 212 continues to combust until fully consumed. The combustion of cylindrical solid propellant casting 212 produces hot combustion products that flow through a plurality of exhaust ports 220 in nozzle cap 218 and into the ramjet combustor (not shown in FIG. 13). Such hot combustion products activate the ramjet (not shown).

In contrast to the conventional ignition devices, the exemplary embodiments of the ignition apparatus disclosed herein do not use pre-loaded springs or other pre-loaded devices thereby eliminating the problems and limitations associated the energy stored by such pre-loaded springs or similar pre-loaded devices. Each exemplary embodiment of the ignition apparatus disclosed herein requires a predefined minimum acceleration to start the ignition sequence (or ignition train) and then a predefined sustained acceleration over time to generate the kinetic energy required to maintain the ignition sequence. If either the predefined minimum acceleration or the predefined sustained acceleration does not occur, then the ignition sequence (or ignition train) is not initiated. Projectiles having an ignition apparatus as disclosed herein may be safely stored indefinitely without the possibility of premature initiation of the ignition sequence.

The foregoing description of illustrated exemplary embodiments of the subject disclosure, including what is described in the Abstract, is not intended to be exhaustive or to limit the disclosed embodiments to the precise forms disclosed. While specific embodiments and examples are described herein for illustrative purposes, various modifications are possible that are considered within the scope of such embodiments and examples, as those skilled in the relevant art can recognize. In this regard, while the disclosed subject matter has been described in connection with various embodiments and corresponding Figures, where applicable, it is to be understood that other similar embodiments can be used or modifications and additions can be made to the described embodiments for performing the same, similar, alternative or substitute function of the disclosed subject matter without deviating therefrom. Therefore, the disclosed subject matter should not be limited to any single embodiment described herein, but rather should be construed in breadth and scope in accordance with the appended claims below.

What is claimed is:

1. An ignition apparatus for initiating an ignition sequence in a projectile, comprising:

a housing including an interior and a rear central opening in communication with the interior;

a sleeve being positioned within the interior of the housing and having a predetermined length, wherein the sleeve includes an interior space, a front end having a front opening and a rear end having a rear opening, wherein the front opening and rear opening are in communication with the interior space, and wherein the rear opening of the sleeve is aligned with the rear central opening of the housing;

a fracturable constraint device being positioned within the interior of the housing and adjacent to the rear central opening, wherein the fracturable constraint device includes a front side that is in abutting relation with the rear end of the sleeve and a rear side that faces the rear central opening, and wherein the fracturable constraint device is configured to fracture when subjected to a predefined magnitude of force caused by axial acceleration of the projectile;

a cap being attached to the housing and positioned within the rear central opening, wherein the cap abuts the rear side of the fracturable constraint device such that the fracturable constraint device is maintained in abutting relation with the rear end of the sleeve;

a firing pin being positioned within the interior space of the sleeve and configured to have high-density so as to provide high inertial mass, wherein the firing pin is secured to the fracturable constraint device;

a percussion primer being positioned within the interior space of the sleeve and spaced apart from the firing pin, wherein the fracturable constraint device is configured to fracture upon being subjected to the predefined magnitude of force thereby setting free the firing pin such that the firing pin does not accelerate with the projectile and is free to move within the interior space of the sleeve, and wherein sustained axial acceleration of the projectile, the predetermined length of the sleeve and the high density portion of the firing pin are configured to cooperate and enable the firing pin to impact with the percussion primer with a force that is sufficient to activate the percussion primer.

2. The ignition apparatus according to claim 1, wherein the sleeve includes an internal structure, which separates the interior space into a first interior space and a second interior space, wherein the internal structure includes an opening therein such that the first interior space is in communication with the second interior space, wherein the firing pin is located within the first interior space and the percussion primer is located within the second interior space, and wherein the firing pin includes a portion that is sized to fit through the opening in the internal structure so as to physical impact the percussion primer.

3. The ignition apparatus according to claim 2, wherein the firing pin further comprises a forward portion that has a substantially conical shape, wherein the sleeve includes an interior surface extending about the first interior space, wherein the interior surface includes an interior portion that has a substantially conical shape that conforms to the conical shape of the forward portion of the firing pin.

4. The ignition apparatus according to claim 2, wherein the firing pin further comprises a forward portion that has a substantially conical shape and which extends to a nose portion, and wherein the nose portion is a portion of the firing pin sized to fit through the opening in the internal structure configured to impact, physically, the percussion primer.

5. The ignition apparatus according to claim 1, wherein the rear central opening of the housing includes a threaded surface, and the cap member has a threaded surface that engages the threaded surface of the rear central opening.

6. The ignition apparatus according to claim 1, wherein the fracturable constraint device is fabricated from a material chosen from the group consisting of Polyether Ether Ketone and Acrylic Resin.

7. The ignition apparatus according to claim 1, wherein the fracturable constraint device further comprises a protruding portion that outwardly extends from the front side of the fracturable constraint device, wherein the firing pin is secured to the protruding portion, and wherein the protruding portion is configured to fracture when the predefined magnitude of force is a predefined magnitude of tensile force.

8. The ignition apparatus according to claim 7, wherein the firing pin includes a bore therein sized to receive the protruding portion.

9. The ignition apparatus according to claim 7, wherein the firing pin includes a bore therein sized to receive the protruding portion, wherein the bore includes an inner surface, and wherein the protruding portion is adhered to the inner surface.

10. The ignition apparatus according to claim 1, wherein the fracturable constraint device further comprises a central portion and a protruding member extending outwardly from the central portion, wherein the protruding member includes a head portion secured to the central portion and a threaded elongated portion attached to the head portion, wherein the firing pin includes a threaded bore and the threaded elongated portion is threadedly engaged with the threaded bore, and wherein the head portion of the protruding member shears off of the central portion when the predefined magnitude of force is a predetermined magnitude of shear force.

11. The ignition apparatus according to claim 10, wherein the protruding member comprises a bolt, which comprises the head portion and the elongated threaded portion.

12. The ignition apparatus according to claim 10, wherein the protruding member comprises a bolt, which comprises the head portion and the elongated threaded portion, and wherein the bolt is fabricated from metal.

13. The ignition apparatus according to claim 1, wherein the firing pin comprises a section fabricated from high-density material.

14. The ignition apparatus according to claim 13, wherein the high-density material is a high density Tungsten material.

15. The ignition apparatus according to claim 1, wherein the firing pin comprises a generally cylindrical section and a high-density member, which attached to the generally cylindrical section.

16. The apparatus according to claim 15, wherein the high-density member is generally cylindrically shaped and is attached to the generally cylindrical section of the firing pin such that the high-density member extends about the generally cylindrical section of the firing pin.

17. The ignition apparatus according to claim 15, wherein the high-density member is fabricated from Tungsten.

18. The ignition apparatus according to claim 1, further comprising generally cylindrical solid propellant member being positioned within the interior of the housing and extending about the sleeve.

19. The ignition apparatus according to claim 18, further comprising:

a combustion chamber comprising an interior being in communication with the front opening in the front end of the sleeve, wherein at least a portion of the generally cylindrical solid propellant member is exposed to the interior of the combustion chamber; and energetic material being disposed within the interior of the combustion chamber, wherein activation of the percussion member is configured to cause combustion of the energetic material disposed within the combustion chamber, which in turn is configured to cause combustion of the generally cylindrical propellant member.

20. The ignition apparatus according to claim 19, further comprising a nozzle cap enveloping the combustion chamber and having at least one exhaust port for exhausting combustion products within the combustion chamber.

* * * * *